United States Patent [19]

Williams

[11] Patent Number: 4,489,664

[45] Date of Patent: Dec. 25, 1984

[54] CLOSED LOOP FUEL FEED SYSTEM FOR MULTIPLE DIRECT FIRED BURNERS

[75] Inventor: Robert M. Williams, Ladue, Mo.

[73] Assignee: Williams Patent Crusher and Pulverizer Company, St. Louis, Mo.

[21] Appl. No.: 551,286

[22] Filed: Nov. 14, 1983

[51] Int. Cl.[3] ..... F23N 5/18

[52] U.S. Cl. ..... 110/186; 110/106; 110/232

[58] Field of Search ..... 110/347, 263, 232, 186, 110/106; 241/34

[56] References Cited

U.S. PATENT DOCUMENTS

| | | | |
|---|---|---|---|
| 1,875,934 | 9/1932 | Sancton | 110/232 X |
| 2,172,731 | 9/1939 | Dickey | 241/35 |
| 2,439,721 | 4/1948 | Dickey | 241/34 X |
| 4,184,640 | 1/1980 | Williams | 241/34 |
| 4,226,371 | 10/1980 | Williams | 241/31 |
| 4,332,207 | 6/1982 | Blaskowski et al. | 110/347 |

*Primary Examiner*—Edward G. Favors

*Attorney, Agent, or Firm*—Gravely, Lieder & Woodruff

[57] ABSTRACT

A closed loop fuel feeding system for multiple direct fired burners in which a conduit system associated with a fuel grinding mill forms a closed loop for conducting the flow of fuel and air back to the mill in excess of the fuel and air not released from the conduit system to burners, ambient air inlet for admitting sufficient air to replace the air released with the fuel from the system, a back pressure configuration to assure uniform fuel to air density when released from the conduit system, and controls to regulate the rate of fuel supply with the rate of grinding and the quantity of air admitted to complete a combustible mixture of fuel and air.

8 Claims, 4 Drawing Figures

CLOSED LOOP FUEL FEED SYSTEM FOR MULTIPLE DIRECT FIRED BURNERS

BACKGROUND OF THE INVENTION

1. Field of the Invention

This invention relates to a fuel feeding system connected in a closed loop circulation system to a plurality of direct fired burners in which fuel is supplied to the burners in accordance with burner capacity to consume the fuel.

2. Description of the Prior Art

It is known that finely ground coal can be utilized in burners, much as a liquid fuel, provided the coal is reduced in size so that it acts in a substantially fluid manner. Examples in the prior art include the control system for feeding fuel to furnaces where pulverizing apparatus is provided for reducing the coal so that it acts as a fluid in a carrier stream of air. The example is disclosed in Dickey U.S. Pat. No. 2,172,317 of Sept. 15, 1939 and in Dickey U.S. Pat. No. 2,439,721 of Apr. 13, 1948. Other examples of apparatus for grinding coal for direct coal fired burner systems are disclosed by Williams in U.S. Pat. No. 4,184,640 of Jan. 22, 1980, and U.S. Pat. No. 4,226,371 of Oct. 7, 1980, and in copending application of Williams, Ser. No. 530,632 filed Sept. 9, 1983.

The problem which exists in direct fired multiple coal burners is one which involves maintaining a proper coal-to-air ratio for each burner and the usual application is to supply all of the ground coal and air into a single burner. However, there is a problem with multiple burners in that it is not possible to take any of the burners out of service without causing the system to shut down. The ability to turn on or turn off various burners in a multiple burner system is desirable, especially in fluid bed combustors or power plants, but that ability has not been made available before now.

BRIEF DESCRIPTION OF THE INVENTION

The objects of the present invention are to provide apparatus for grinding and recirculating ground or pulverized coal in a closed loop multiple burner direct fired system, to provide means for controlling the density of the coal in the closed loop recirculating system, to provide a closed loop recirculating system for multiple burners in which a back pressure is created in the system to substantially equalize and control the coal and air flow into each of a plurality of burners, and to provide a control over the coal grinding apparatus so that it can be made to operate at a rate sufficient to maintain an appropriate density of coal to air.

A preferred embodiment of the present invention includes a fuel grinding mill with centrifugally swung rolls for obtaining a fuel grinding result which regulates the fineness of the fuel particles which are directly transported in a closed loop circulating system to a plurality of burners, and control means over the air supply so as to detect the temperature of and volume or weight of the air moving into the system in terms of the number of burners being supplied at a given time. The air supply control in the foregoing embodiment is applied to control the fuel feed and the mill grinding speed so as to match the grinding rate with the feed rate.

BRIEF DESCRIPTION OF THE DRAWINGS

The present invention is illustrated in the accompanying drawings, wherein.

DETAILED DESCRIPTION OF THE PREFERRED EMBODIMENT

Figure 1:
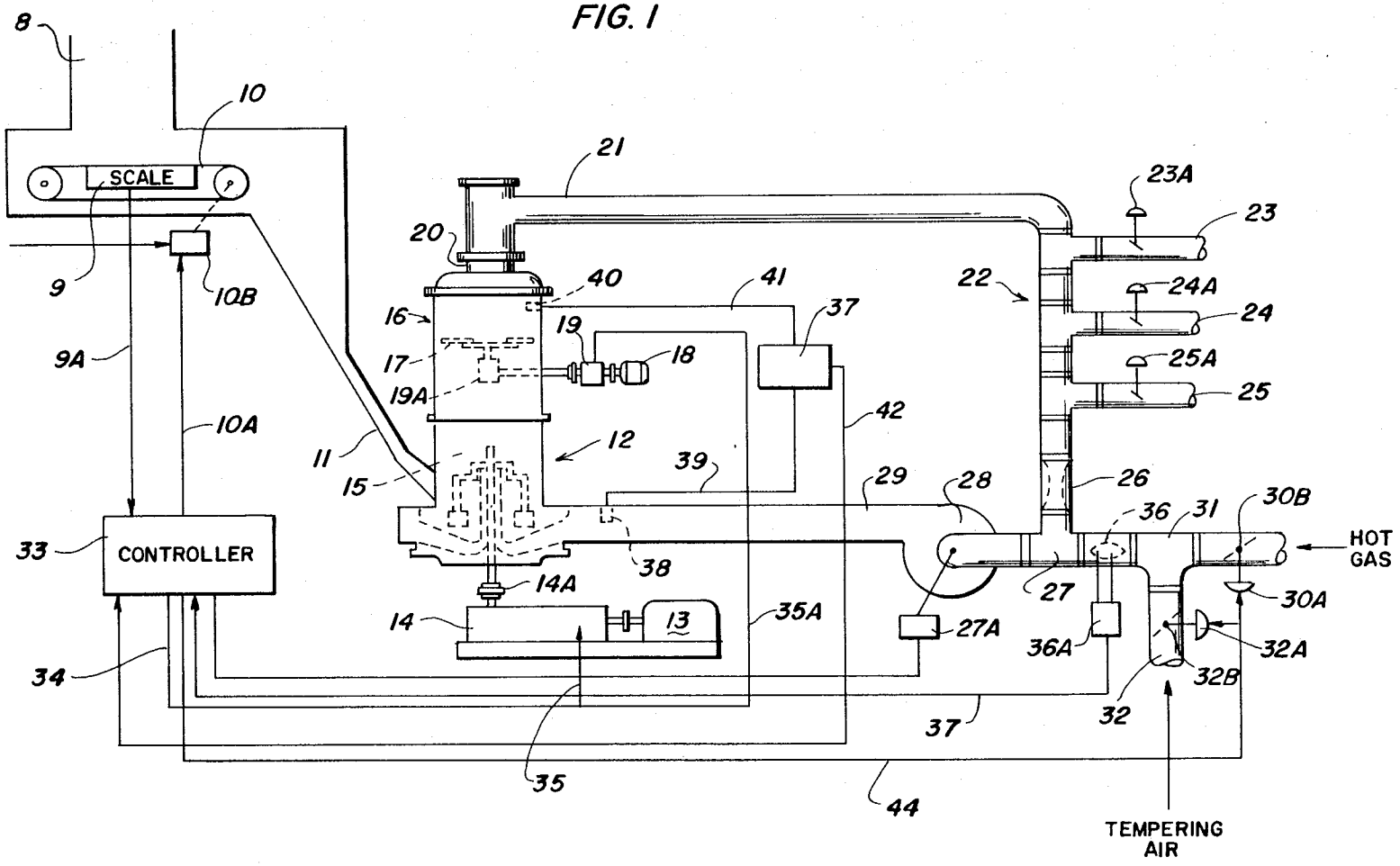
FIG. 1 is a schematic arrangement of the various components making up an operative closed loop fuel feed system for multiple direct fired burners.

A presently preferred embodiment of the present invention is illustrated in the schematic arrangement of FIG. 1 in which fuel, such as coal, is supplied to a feed hopper 8 which is then delivered through a weigh scale 9 which is part of a gravometric feeder device 10 and chute 11 into the grinding chamber of a mill 12. The mill 12 is driven by a prime mover 13 connected through a transmission 14 to the main drive shaft 14A which is controllable as will be presently described. The outlet from the mill is in the form of vertical stack 15 connected to a spinner separator 16 which is equipped with an internal rotor 17 driven by a suitable prime over 18 through a transmission 19 and gearing 19A. The purpose of the separator 16 is to return to the mill 12 oversized particles which require further reduction, and to allow the coal which has been satisfactorily ground to pass to an outlet 20.

Outlet 20 connects to conduit 21 to move the air impelled ground coal into the conduit 22 which is then connected to a series of outlets which are intended to be connected to burners (not shown) for the direct firing of the burners. Three such outlets 23, 24, and 25 are shown and each is provided with a control valve at 23A, 24A and 25A respectively so that all or less than all, as are needed, can be supplied with the coal and air. The conduit 22 continues on past the outlets so as to be connected to fan inlet tee 27 for a circulating fan 28. In this manner, the transportation of the ground coal in the mill 12 is transported through the above described system and excess coal and air is returned by the fan 28 through the circulating conduit 29 to the air inlet at the mill 12. There is connected into the air and coal circulating system a back pressure device 26 which may be in the form of a venturi (shown), or it may be a simple adjustable restrictor gate which can be set to vary the back pressure in the conduit system. The foregoing system further embodies the provision of a heated air inlet 30 from any suitable source of heat. That inlet 30 is connected to a tee 31 which receives and mixes a portion of tempering air from the conduit 32 with heated air from inlet 30.

The foregoing arrangement of the components is subject to regulation by a central controller 33 having a lead 10A to the motor 10B operating feeder 10, and having a lead 9A from weigh scale 9 to respond to the rate and quantity of coal being fed. In addition, there is a principal lead 34 connected to branch 35 connected to the speed control transmission 14, and by branch lead 35A to the speed control transmission 19 in spinner separator 16. This phase of the control is intended to operate the speed of the mill drive shaft 14A inversely to the speed of the drive 19A for the spinner operator 15. Thus, as the mill speed increases to increase grinding capacity of the coal, the spinner separator speed is reduced. The operation of the mill for grinding coal is subjected to certain signals received by the controller 33 from an air flow sensitive pilot device 36 placed in the air duct system on the inlet side of fan 28. Fan start up will draw air in from the inlets, and that flow will be sensed by the device 36 which sends a signal by lead 37 to the controller 33 in response to the weight of the air at the flow measuring device 36. It is necessary to supply air in sufficient quantity to make the system function properly. This is accomplished by the controller 33 translating the signals from the device 36 into control of the motor 30A for inlet valve 30B, and control of the motor 32A for inlet valve 32B, so that the temperature of the air can be adjusted by introducing tempering air into the hot gas. In this way the air flow is converted by controller 33 into pounds of air flow per minute, and when the air velocity is above a minimum of 3500 CFM for any one outlet 23, 24 or 25, to one burner the controller will start mill operation. Thus, the occurrence of air flow is the prime factor for operating the mill 12 and the coal feeder 10 so that the ratio of 2.7 pounds of air per pound of coal is maintained. Feeder 10 is commanded by controller 33 to feed coal proportionate to air flow and as noted, a normal setting would be 2.7 pounds of air per pound of coal.

At the same time the mill 12 grinding rate is adjusted by controller 33 to match that of the feed rate. This is done by varying the mill speed transmission 13 as the fourth root of the feed rate. Thus, if the burners are opened up to utilize 57,000 pounds of air per hour (measured by the air input device 36), the feeder would be set to feed at one-third of that rate, or 19,000 pounds of coal per hour. Assuming this to be the full capacity of the pulverizer, the mill speed would be 100%. The main fan 28 would be set to handle the 57,000 pounds of air per hour plus one-third more air for recirculation and to hold pressure on all burners by means of the back pressure in the conduit system 22, thus the fan would handle 76,000 pounds of air per hour at all times when all outlets 23, 24 and 25 are open. As burners are turned off, for example, to a 50% condition, the main fan 28 would still recirculate 76,000 pounds of air per hour, the exhaust gas from the burners would be 57,000/2=28,500 pounds/hour. Thus, the air flow into the system as measured by flow device 36 would so indicate. This, in turn, would set the feeder 10 to input at the one-third ratio or 9,500 pounds of coal per hour, the mill speed would drop to the fourth root of the feed rate change or $$\sqrt[4]{\frac{9500}{19000}} = \sqrt[4]{50\%} = 84\%$$

at the same time the speed of spinner separator 16 varies inversely to the mill speed. As the mill speed goes down, the spinner speed goes up, thereby maintaining particle coal size at a minimum of 70%—200 mesh. Concurrently, a pressure differential safety net is set to guard against the mill 12 grinding rate being out of adjustment with the feed rate of the feeder 10. This is done by setting a pressure differential or manometer device 37 at a pressure differential maximum limit that increases as the air flow increases. The device 37 responds to signals from a pressure sensor 38 in the air inlet conduit 29 to the mill 12 connected by lead 39, and signals from a similar sensor 40 in the separator 16 connected by lead 41. The signals from sensors 38 and 40 are translated into the pressure differential across the mill 12 and separator 16 and that signal is fed to controller 33 by lead 42. Normally, the mill 12 has a comfortable grinding zone of from 3 to 8 inches of pressure differential and as different coals of different grinabilities are fed, the mill 12 will normally stabilize somewhere within this range. However, should something go wrong and the grinding rate not match the feed rate, then the pressure differential would continue to rise until the pressure differential maximum limit would be reached (approximately at 10 inches) at which point the controller 33 would modulate down the feed rate of feeder 10 to match the grinding capacity of the mill 12. The controller 33 would also send an alert message to the operator that an investigation of the cause of the problem should be made.

A more detailed disclosure of the control system for this invention is seen in copending application Ser. No. 530,632 filed Sept. 9, 1983, and the same is incorporated herein by reference. This is done in increments of approximately 5% speed adjustment which adjusts the grinding rate by about 16%. If, on the other hand, should the mill grinding rate run away from the feed rate and the pressure differential across the mill 12 drop below the maximum pressure differential limit by 3 inches, then again the operator would be notified and after a timed cycle (approximately 10 minutes) the system would shut down or in a full automatic system the mill would slow down to match that feed rate. In all cases, the operator would be notified to determine the cause.

When the system is to be shut down, the coal therein needs to be cleaned out of all conduits 21, 22, 27 and 29. The shut down of the system is accomplished with at least one of the burner control valves 23–25 open and the igniter for the related burner in the "on" setting.

The foregoing apparatus possesses a number of advantages over known prior apparatus which functions in a similar or even like manner. It is a feature to be able to eliminate a cyclone type separator and a bag house. The recirculating flow of air borne ground coal allows the multiple burner feeder outlets to be all open at valves 23–25 or it allows some to be cut off and reopened as needed. The start up air flow by fan 28 is admitted at inlet 30 under control of valve 30B and at inlet 32 under control of valve 32B. The valve motors 30A and 32A are subject to control signal from controller 33 by lead 49. There is the further distinct advantage in the present apparatus that the mill 12 can be operated at a negative pressure so all leaks are maintained at a positive pressure. Furthermore, the coal to air density ratio can be modified by mill grinding rate to suit the burner requirements when all or some outlet valves 23A to 25A are open.

Figure 2:
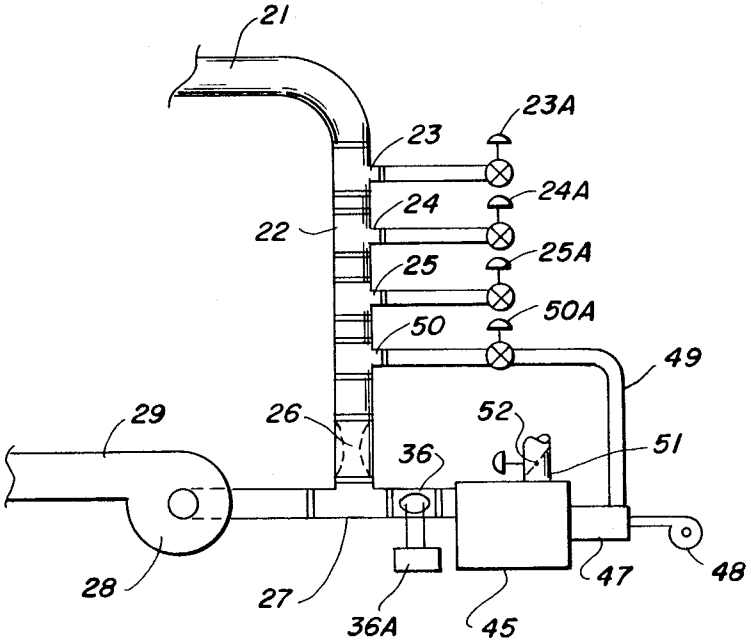
FIG. 2 is a fragmentary schematic arrangement of a portion of a system comparable to the system shown in FIG. 1.

Turning to FIG. 2 there is illustrated only a portion of a system for feeding ground air borne coal to burner outlets 23, 24 and 25 from conduit 22, which conduit 22 is connected into the conduit 21 of the components shown and described in FIG. 1. Similarly, the fan 28 is connected to conduit 29 which is part of the FIG. 1 system. The difference of FIG. 2 over FIG. 1 resides in the presence of a hot gas generator 45 being connected by its outlet 46 to the air measuring flow device 36. The generator 45 is provided with a burner 47 having combustion air supplied by a blower 48, and a fuel supply at conduit 49 which is connected into an outlet 50 from conduit 22 through a control valve 50A. Tempering air is admitted to the generator 45 at inlet 51 under control of the motorized valve 52. This arrangement is operated in a manner similar to the arrangement shown in FIG. 1, and it is believed unnecessary to repeat that disclosure.

Figure 3:
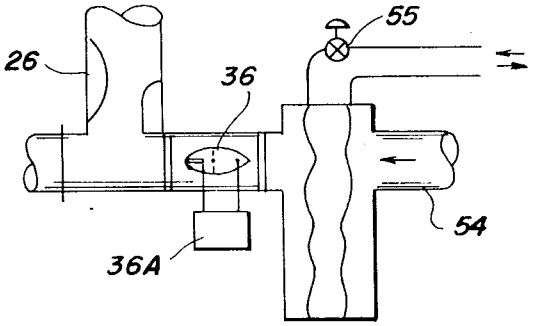
FIG. 3 is a fragmentary detail for an alternate source of heat for the air supply to systems of FIGS. 1 or 2.

The fragmentary view of FIG. 3 illustrates the substitution of a steam heat exchanger 53 inserted in the air supply conduit 54 in place of the heat generator 45 of FIG. 2. The steam supply piping is equipped with a control valve 55.

Figure 4:
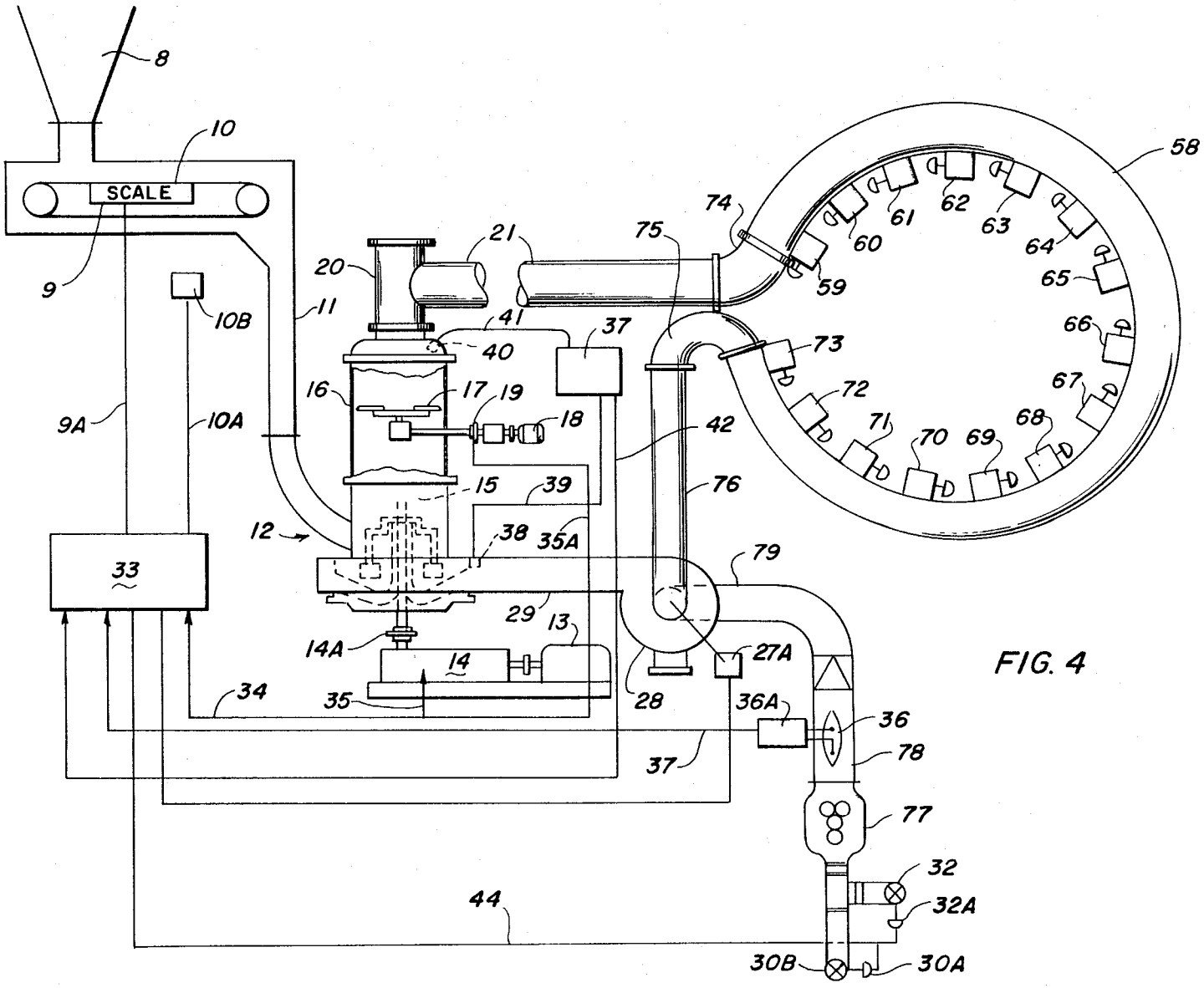
FIG. 4 is another schematic arrangement of a closed loop multiple burner system for the direct firing of the burners.

FIG. 4 is a further example of a closed loop fuel feed system for an arrangement where a plurality of burners need to be arranged in series for surrounding a space, such as in a blast furnace, where the heat is to be concentrated. Where applicable, the components which are the same as for those shown and described in FIG. 1 will be designated by the same reference numerals so as to avoid repetitious description. The components which are different reside in the conduit loop 58 being tapered for equalizing coal and air supply to each of a plurality of fifteen (15) outlets 59 to 73. The loop 58 is connected by fitting 74 to conduit 21 and its opposite end is connected by a second fitting 75 to a conduit 76 ending at the suction inlet of the fan 28. The carrier air for this system is provided at hot gas inlet 30 and a tempering air inlet 32 under control of dampers 30B and 32B, all as previously described in FIG. 1.

The carrier air is pressurized in a suitable compressor 77, the outlet of which is conduit 78 which is connected by conduit 79 into the circulation system 21, 58, 76 at the inlet to fan 28. The air flow measuring and pressure sensitive device 36 generates signals which represent the pressure conditions in the inlet air flow through inlet conduit 78. The compressor 77 creates the back pressure in the circulating system just as the venturi device 26 in FIG. 1 establishes a back pressure.

The present invention is unique in that it is directed to a closed loop fuel feeding system for multiple burners arranged in consecutive order, and in which a conduit system associated with a fuel grinding mill has an inlet end for receiving the ground fuel moved by combustion supporting air and an outlet end for returning to the mill fuel and air not released from the conduit system to multiple burners. The conduit system receives ambient air in quantity to replace the air released with the ground fuel, and control means is provided to regulate the rate of fuel supply to the mill in keeping with the rate of grinding of that fuel, and to maintain a volume of air admitted to the conduit system so that the fuel to air ratio reaches the proper mixture for combustion of the fuel released from the conduit system to one or more burners.

An important improvement resides in the ability of the present system to continue operating when less than all of the burner outlets are open, and also to be able to clean out all of the coal by keeping one burner outlet open to consume the residual coal in the system.

What is claimed is:

1. A closed loop fuel feed system for multiple direct fired burners comprising:

(a) fuel grinding and particle size classifying means having an inlet for fuel to be ground, an air inlet and a ground fuel and air outlet;

(b) conduit means connected between said ground fuel and air outlet and said air inlet constituting a substantially closed loop for the movement of ground fuel and air;

(c) fan means inserted into said conduit means constituting said closed loop for effecting the movement of ground fuel and air;

(d) a series of ground fuel and air outlets connected into said closed loop in consecutive order for extracting the ground fuel and air for delivery to burners;

(e) means for delivering fuel to said fuel grinding and classifying means;

(f) means for admitting air into said conduit means from the exterior;

(g) means responsive to the flow of air mounted in said air admitting means; and (h) control means for operating said fuel delivering means, said air admitting means, said air flow responsive means, and said fan means, said control means initiating operation of said fuel grinding means upon response of said air flow responsive means indicating sufficient air admitted to said conduit means to support combustion of the fuel and to main a substantially uniform density of ground fuel and air extracted at each of said outlets connected into said closed loop.

2. The closed loop fuel fee system set forth in claim 1 characterized in that said fuel grinding means is a roller mill having centrifugally swung grinding rollers.

3. The closed loop fuel feed system set forth in claim 1 characterized in that said conduit means is configured such that it maintains the substantially uniform density of ground fuel and air at each of said series of ground fuel and air outlets.

4. The closed loop fuel feed system set forth in claim 3 characterized in that said conduit means configuration includes a flow restriction disposed at a position beyond said series of ground fuel and air outlets.

5. The closed loop fuel feed system set forth in claim 3 characterized in that said conduit means configuration includes a substantially uniform change in the cross-section of said conduit means associated with said ground fuel and air outlets.

6. The closed loop fuel feed system set forth in claim 1 characterized in that said means for admitting air into said conduit means from the exterior includes a pair of inlets for intermingling air of different temperature values.

7. A closed loop fuel feed system for multiple direct fired burners comprising:

(a) a fuel conveying conduit having an inlet for the reception of fuel and an outlet for the fuel;

(b) fuel grinding means connected between said inlet and outlet of said conveying conduit;

(c) air moving means connected into said conveying conduit in advance of said outlet, said air moving means supplying air into said fuel grinding means for conveying ground fuel through said conduit and back to said outlet;

(d) a plurality of fuel outlets branching from said conveying conduit, each branch outlet having means for opening and closing the same; and (e) flow restrictor means in said conveying conduit beyond the fuel outlet branches for creating a back pressure in said conveying conduit such that fuel and air flow to the open ones of said plurality of outlet branches is substantially equalized.

8. A closed loop fuel feed system for multiple direct fired burners comprising:

(a) a coal grinding mill having a grinding chamber, a coal feeding inlet, an air inlet and an outlet for air borne ground coal;

(b) coal feeding means connected to said coal feeding inlet;

(c) drive means connected to said mill;

(d) a ground coal circulating conduit system having opposite ends, one of which is connected to said mill outlet and the other end connected to said grinding chamber air inlet;

(e) air moving means inserted in said circulating conduit for moving the ground coal therein;

(f) a plurality of burner take-off outlets in said coal circulating conduit located beyond said mill outlet, said outlets diverting and directing ground coal and air out of said circulating conduit system;

(g) means connected into said circulating conduit system downstream of said plurality of outlets to create a back pressure on the flow of coal and air in said circulating conduit system for assuring availability of coal and air at each outlet;

(h) responsive means connected into said circulating conduit system for monitoring the amount of air admitted to the conduit system; and (i) control means connected to said coal grinding mill, said coal feeding means and said air flow responsive means for regulating the coal feeding rate and grinding rate of said mill in predetermined proportion so the ratio of the weights of ground coal to the weight of air is substantially 2.7 pounds of air for each pound of ground coal.

* * * * *

UNITED STATES PATENT AND TRADEMARK OFFICE

CERTIFICATE OF CORRECTION

PATENT NO. : 4,489,664

DATED : December 25, 1984

INVENTOR(S) : Robert M. Williams

It is certified that error appears in the above-identified patent and that said Letters Patent is hereby corrected as shown below: On the title page:

In the U.S. list of references U.S. Patent "2,172,731" should be corrected to read "2,172,317".

Col. 1, line 60, "circulating" should be corrected to read "recirculating".

Col. 2, line 30, "over 18" should be corrected to read "mover 18".

Col. 2, line 49, "circulating" should be corrected to read "recirculating".

Col. 3, line 6, "subjected" should be corrected to read "subject".

Col. 6,claim 1, subpart (h) at line 23, "main" should be corrected to read "maintain".

Signed and Sealed this

*Twenty-fifth* Day of *June 1985*

[SEAL]

*Attest:*

DONALD J. QUIGG

*Attesting Officer*

*Acting Commissioner of Patents and Trademarks*